US009947246B1

(12) United States Patent
Weisburn

(10) Patent No.: US 9,947,246 B1
(45) Date of Patent: Apr. 17, 2018

(54) SIGN FOR DISPLAYING CHANGEABLE INFORMATION

(71) Applicant: INTERIOR GRAPHIC SYSTEMS, LLC, North Canton, OH (US)

(72) Inventor: James T. Weisburn, North Canton, OH (US)

(73) Assignee: Interior Graphic Systems, LLC, North Canton, OH (US)

( * ) Notice: Subject to any disclaimer, the term of this patent is extended or adjusted under 35 U.S.C. 154(b) by 0 days.

(21) Appl. No.: 15/296,420

(22) Filed: Oct. 18, 2016

(51) Int. Cl.
*G09F 7/00* (2006.01)
*G09F 1/10* (2006.01)
*G09F 1/02* (2006.01)

(52) U.S. Cl.
CPC . *G09F 1/10* (2013.01); *G09F 1/02* (2013.01)

(58) Field of Classification Search
USPC ..... 40/489, 490, 491, 122, 654, 611.1, 40/611.08, 611.09
See application file for complete search history.

(56) References Cited

U.S. PATENT DOCUMENTS

| | | | | |
|---|---|---|---|---|
| 804,882 | A * | 11/1905 | Rogers | G09F 11/00 40/490 |
| 3,409,347 | A * | 11/1968 | Vogel | G02B 27/021 206/37 |
| 5,428,914 | A | 7/1995 | Whitehouse et al. | |
| 5,555,660 | A | 9/1996 | Whitehouse et al. | |
| 7,146,758 | B1 * | 12/2006 | Gaston | G09F 11/00 40/490 |
| 2010/0199532 | A1 * | 8/2010 | Blue | G09F 7/18 40/491 |

* cited by examiner

*Primary Examiner* — Joanne Silbermann
(74) *Attorney, Agent, or Firm* — Sand & Sebolt

(57) ABSTRACT

A display sign mountable on a support surface where at least some of the information displayed thereon needs to be changed periodically. The sign includes a housing with one or more pockets defined therein, where an interior of each pocket is visible through an associated window on the housing. A set of display cards is receivable in each pocket in the housing. Each display card has different text or graphics thereon. Individual display cards may be selectively withdrawn from the set of display cards by grasping a tab on that particular display card and pulling the display card out of the pocket. The removed display card may be inserted in front of an outermost display card that was previously visible through the associated window. A single display card that is free of tabs may be inserted into one of the pockets and remain substantially permanently visible through the associated window.

18 Claims, 15 Drawing Sheets

SIGN FOR DISPLAYING CHANGEABLE INFORMATION

BACKGROUND

Technical Field

This invention relates generally to signs for displaying information. More particularly this invention is directed to display signs that may be mounted on a support surface such as a building wall, where at least some of the displayed information on the sign needs to be changed periodically. Specifically, this invention relates to a sign comprising a housing with one or more pockets defined therein, where an interior of each pocket is visible through an associated window on the housing; and one or more sets of display cards, each display card including different text or graphics thereon; each set of display cards being received in different pocket of the housing; and wherein individual display cards may be withdrawn from the set of display cards and be inserted in front of an outermost display card that was previously visible through the associated window.

Background Information

It is quite common for large office buildings, universities, hospitals and other institutions to mount informational signs on a wall adjacent an entry to a room in the building or institution. This informational sign is provided to let visitors or users know what business, doctor, service etc. is provided in that particular room or sector of the building.

The function of a particular room or sector of a building may change from time to time and this likely will require the information on the informational sign to be changed. Depending on the function or service the room provides, the information displayed on the sign may need to be changed more than once a day, once every few days, weekly, once a month or term or every few years. Furthermore, only some of the information may need to be changed on the sign while other information needs to remain constant. For example, in a hospital a display sign may be needed to permanently show the service provided in that particular room but the name of an attending physician working in that room may need to change every shift. In a university, the name of a particular laboratory or faculty office need to be displayed permanently but other information such as a course name or number or the name of a professor teaching that class may need to change every hour.

SUMMARY

There is therefore a need in the art for a display sign that enables information displayed therein to be changed quickly and easily.

The changeable sign disclosed herein serves this purpose. The display sign includes a housing with one or more pockets defined therein; where an interior of each pocket is visible through an associated window on the housing. A set of display cards is receivable in each pocket in the housing. Each display card has different text or graphics thereon. Individual display cards may be selectively withdrawn from the set of display cards by grasping a tab on that particular display card and pulling the display card out of the pocket. The removed display card may be inserted in front of an outermost display card that was previously visible through the associated window. A single display card that is free of tabs may be inserted into one of the pockets and remain substantially permanently visible through the associated window.

In one aspect, a changeable sign may comprise: a housing having a front wall and a rear wall; a pocket defined in the housing; a window provided on the front wall, wherein an interior of the pocket is visible through the window; and one or more display cards shaped and sized to be received in the pocket; wherein each of the one or more display cards has different text or images thereon; and wherein the one or more display cards form a set of display cards that is receivable in the pocket; and when the set of display cards is so received, the text or images on an outermost display card of the set of display cards is visible through the window.

Each of the one or more display cards may have an upper edge and a side edge; and a tab may extend outwardly from the side edge; and when the set of display cards is received in the pocket, the tab of each of the one or more display cards may extend outwardly beyond a side edge of the front wall of the housing. The tab of each of the one or more display cards may be located at a distance from the upper edge thereof; and wherein the distance of the tab from the upper edge of each of the one or more display cards in the set of display cards differs from the distances of the tabs of all other display cards in the set of display cards. When the set of display cards is received in the pocket, the tabs of all of the one or more display cards in the set of display cards may be staggered relative to each other. Text or images may be provided on each tab; and when the set of display cards is received in the pocket, the text or images on all the tabs may be visible no matter an order of the display cards in the set of display cards.

In another aspect, a sign for displaying changeable information may comprise a housing having a front wall and a rear wall; a first pocket defined in the housing; a first window provided on the front wall, wherein an interior of the first pocket is visible through the window; at least one additional pocket defined in the housing; wherein the at least one additional pocket is separated from the first pocket; at least one additional window provided on the front wall; wherein an interior of the at least one additional pocket is visible through the at least one additional window; and a first set of display cards shaped and sized to be received in the first pocket; at least one additional set of display cards shaped and sized to be received in one of the one or more additional pockets; wherein each display card in the first set of display cards or the at lest one additional set of display cards has different text or images thereon; and when the set of display cards is so received, the text or images on an outermost display card of the first set of display cards is visible through the first window; and an outermost display card of the at least one additional set of display cards is visible through the at least one additional window.

In another aspect, a method of changing information displayed on a wall sign may comprise the steps of providing a sign comprising a housing having a front wall and a rear wall; a first pocket defined in the housing; a first window provided on the front wall, wherein an interior of the first pocket is visible through the window; inserting a first set of display cards into the first pocket; where the first set of display cards includes one or more display cards that have different graphic images or text thereon; positioning an outermost display card of the one or more display cards adjacent the first window; displaying the text or graphics on the outermost display card through the first window; selecting one of the one or more display cards from a remaining portion of the first set of display cards; removing the selected one of the display cards from the first pocket; and inserting the removed display card in front of the outermost display card; and displaying the text or graphics on the inserted display card through the first window.

In the method, the step of removing the selected one of the display cards may include grasping a tab provided on the selected one of the display cards; pulling on the grasped tab; and sliding the selected one of the display cards out of the first pocket.

The step of providing the housing may further comprise providing at least one additional pocket in the housing; wherein the at least one additional pocket is separated from the first pocket; providing at least one additional window on the front wall of the housing; wherein an interior of the at least one additional pocket is visible through the at least one additional window; and the method may further comprise selecting one of the at least one additional pockets; inserting at least a single display card into the selected one of the at least one additional pockets; and semi-permanently interlocking the inserted single display card into the selected one of the at least one additional pockets.

BRIEF DESCRIPTION OF THE SEVERAL VIEWS OF THE DRAWINGS

A sample embodiment is set forth in the following description, is shown in the drawings and is particularly and distinctly pointed out and set forth in the appended claims.

Similar numbers refer to similar parts throughout the drawings.

DETAILED DESCRIPTION

Figure 1:
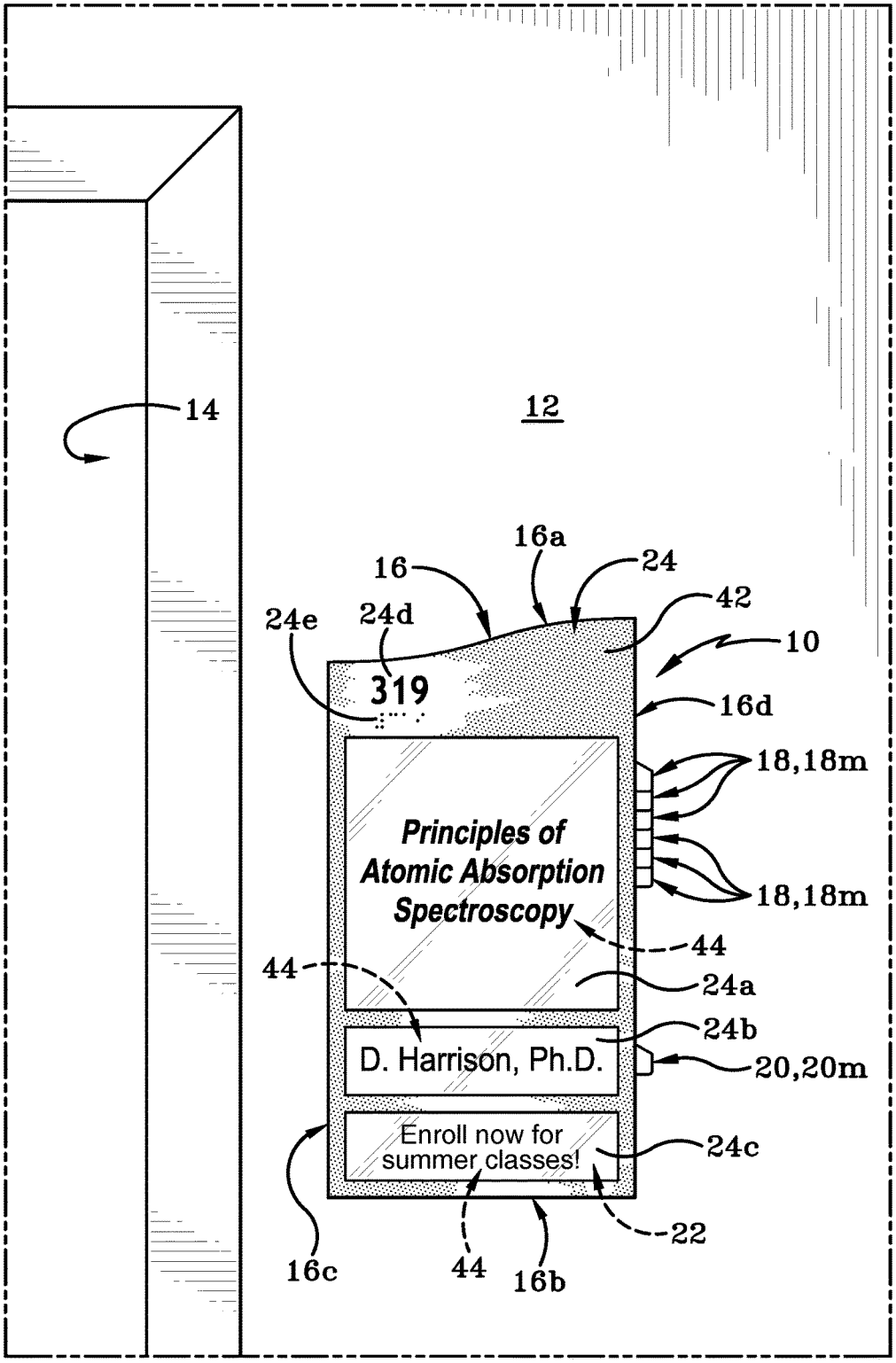
FIG. 1 is a front elevation view of a changeable sign in accordance with an aspect of the present invention shown mounted on a building wall.

Referring to FIGS. 1-13, there is shown a changeable sign in accordance with an aspect of the present invention, generally indicated at 10. Sign 10 is shown in FIG. 1 mounted on a wall 12 adjacent a doorway 14 into a room. Sign 10 comprises a housing 16 and a plurality of display cards 18, 20, 22. Housing 16 is mounted on wall 12 by any suitable means and display cards 18, 20, 22 are selectively received in housing 16.

Display cards 18, 20, 22 may be provided as a first set of cards 18, a second set of cards 20 and a third set of cards 22. The first set of cards 18 may include a plurality of cards such as the six cards illustrated herein, namely, cards 18A, 18B, 18C, 18D, 18E, and 18F. (Any number of cards may be provided in this first set of cards 18. The second set of cards 20 may include a plurality of cards such as the six cards 20A, 20B, 20C, 20D, 20E and 20F illustrated herein. (Any number of cards may be provided in this second set of cards 20.) Third set of cards 22 may include a plurality of cards but in the instance illustrated herein the third set of cards comprises just a single card 22. The reason for this will be explained later herein.

Figure 2:
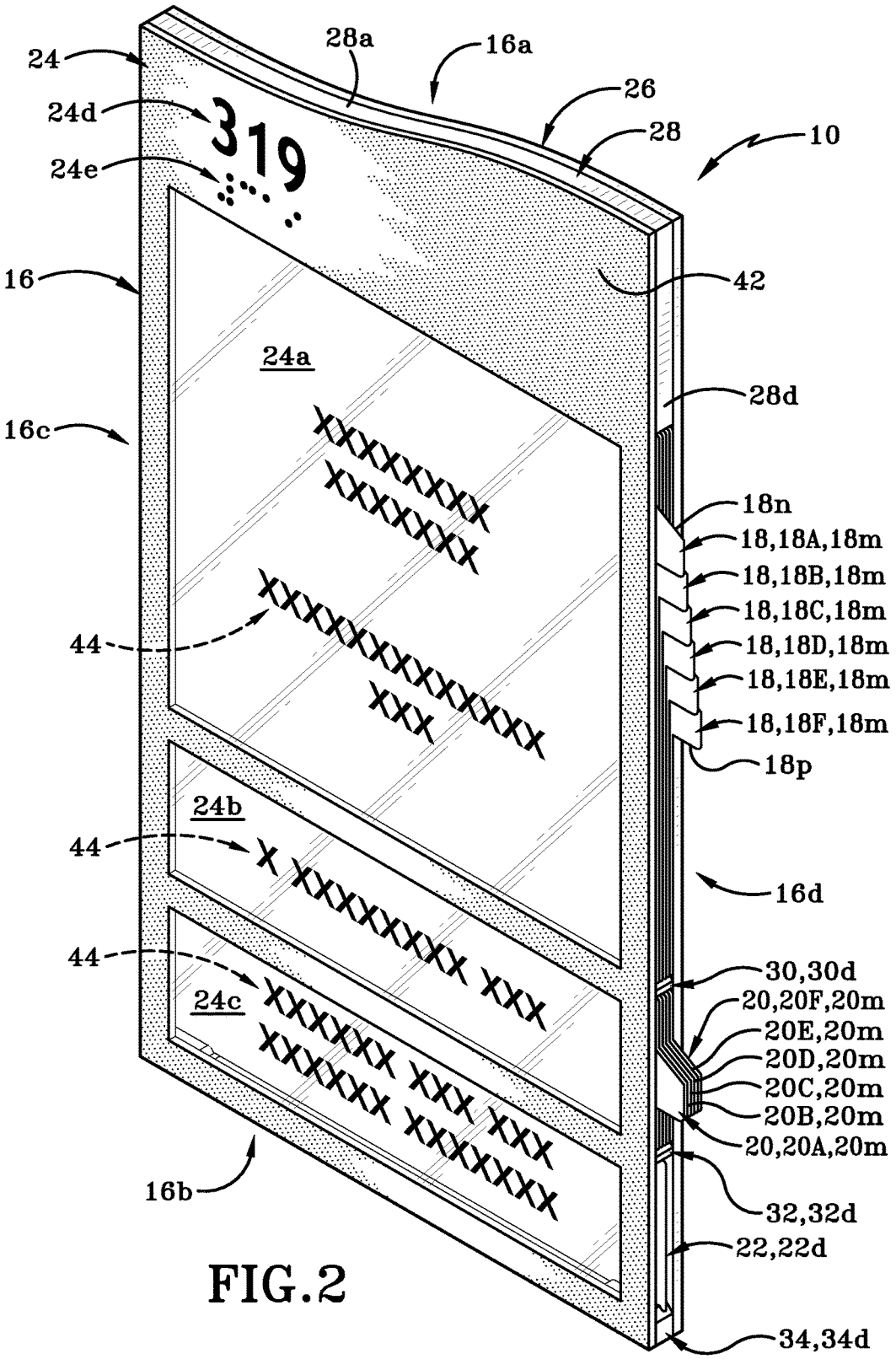
FIG. 2 is a perspective view of the sign shown on its own.
Figure 3:
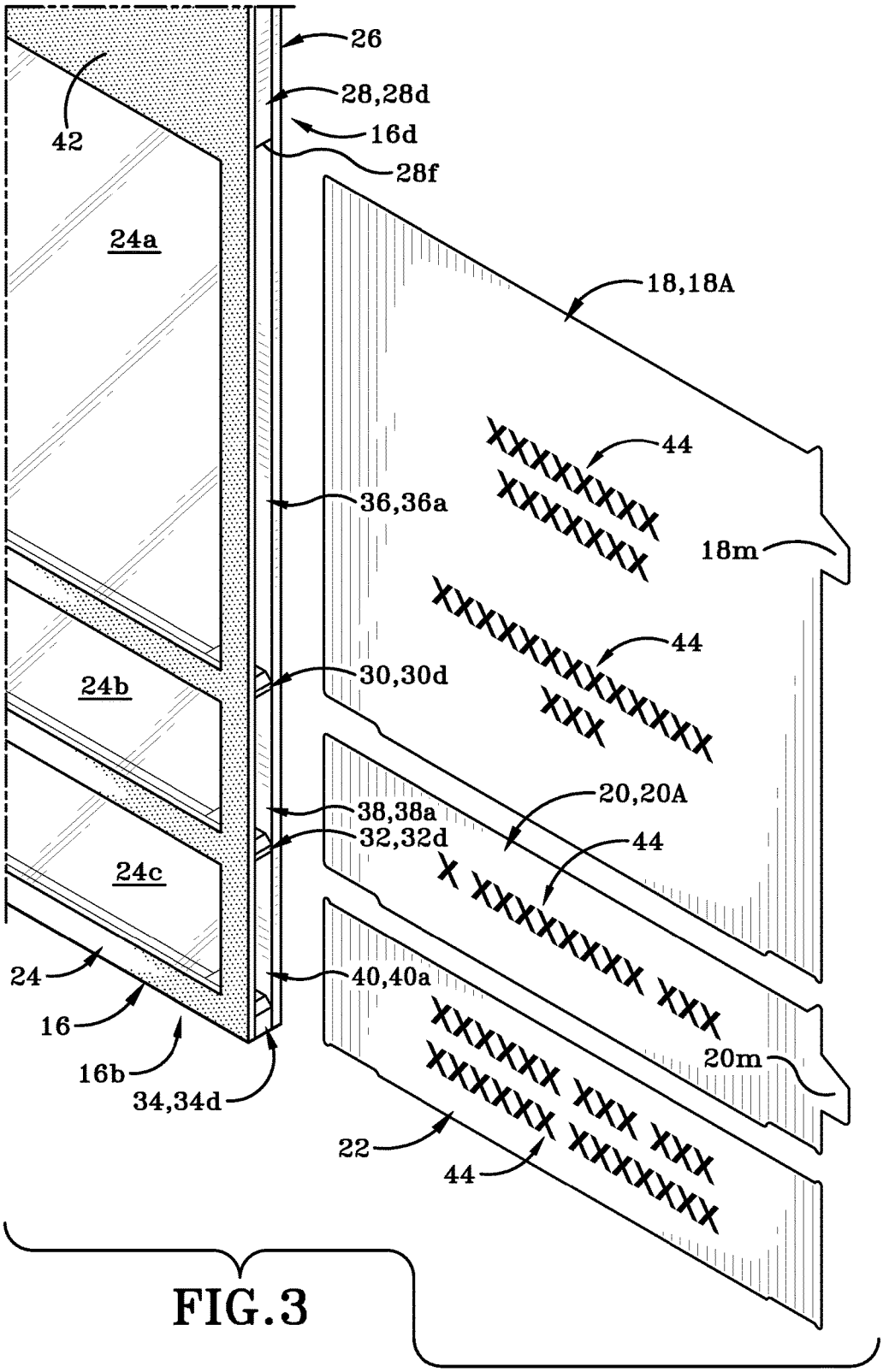
FIG. 3 is a partial exploded perspective view of the sign showing the display cards separated from the holder.
Figure 4:
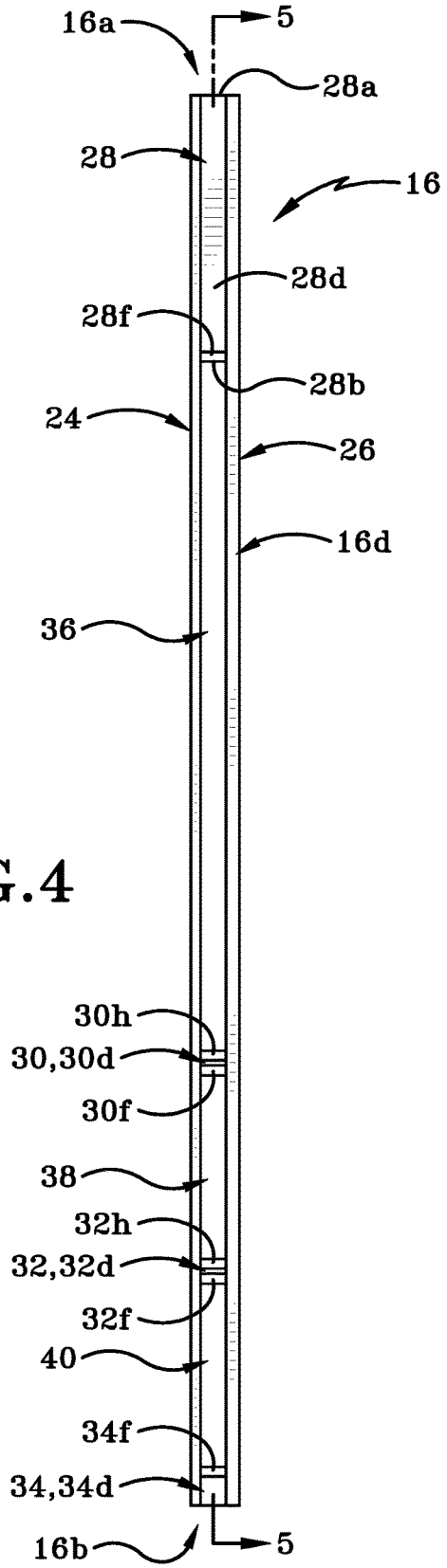
FIG. 4 is a right side view of the holder; the left side view of the holder will be a mirror image hereof.

Referring to FIGS. 2-4, housing 16 has an upper end 16*a*, a lower end 16*b*, a first side 16*c* and a second side 16*d*. Housing also includes a front wall 24, a rear wall 26, a first spacer 28, a second spacer 30, a third spacer 32, and a fourth spacer 34. Rear wall 26 is designed to be located adjacent the exterior surface of building wall 12 and appropriate mounting members (not shown) may be used to secure rear surface 26 to building wall 12.

Front wall 24 and rear wall 26 may be molded from a transparent plastic material and are positioned so that there top and bottom edges and left and right side edges are aligned. First, second, third, and fourth spacers 28, 30, 32 and 34 are sandwiched between front wall 24 and rear wall 26. Three pockets are defined within housing 16. A first pocket 36 is defined by the interior surfaces of front wall 24 and rear wall 26, the lower edge 28*b* of first spacer 28 and the upper edge 30*a* of second spacer 30 and is accessible through openings in each of first side 16*c* and second side 16*d* of housing 16. The opening 36*a* (FIG. 5) to first pocket 36 in second side 16*d* may be seen in FIGS. 3 and 4. First pocket 36 may be of a first length "L1" (FIG. 5) defined as the distance between lower edge 28*b* of first spacer 28 and upper edge 30*a* of second spacer 30.

A second pocket 38 is defined by the interior surfaces of front wall 24 and rear wall 26, the lower edge 30*b* of second spacer 30 and the upper edge 32*a* of third spacer 32 and is accessible through openings 38*a* (FIG. 5) defined in each of first side 16*c* and second side 16*d* of housing 16. The opening to second pocket 38 in second side 16*d* may be seen in FIGS. 3 and 4. Second pocket may be of a second length "L2" defined as the distance between lower edge 30*b* and upper edge 32*a*.

A third pocket 40 is defined by the interior surfaces of front wall 24 and rear wall 26, the lower edge of third spacer 32 and the upper edge 34*a* of fourth spacer 40 and is accessible through openings 40*a* (FIG. 5) defined in first side 16*c* and second side 16*d* of housing 16. The opening to third pocket 40 in second side 16*d* may be seen in FIGS. 3 and 4.

Third pocket 30 may be of a third length "L3" defined as the distance between lower edge 32*b* and upper edge 34*a*.

Front wall 24 includes regions that are covered by an opaque or a translucent covering 42. Covering 42 may be stippling, texturing, color, a decal or any other surfacing that makes regions of front wall opaque or translucent. Three areas of front wall 24 are free of this covering 42 and therefore remain transparent. These three transparent areas are identified in FIG. 3 by the reference numbers 24*a*, 24*b* and 24*c* and form first, second and third windows, respectively, that enable someone looking at sign to see information 44 that is printed on a front surface of each of the cards in the first, second and third sets of cards 18, 20, 22.

As illustrated in FIG. 1, in certain instances graphic text or images 24*d* may be printed, marked, embossed or otherwise applied to an outermost surface of front wall 24. So, for example, a room number may be provided on front wall 24 as graphic text or images 24*d*. Furthermore, a braille rendition 24*e* of that text or image 24*d* may be provided on front wall 24. It will be understood that this text or image 24*d* and braille rendition 24*e* may be provided at any desired position on front wall 24.

Figure 5:
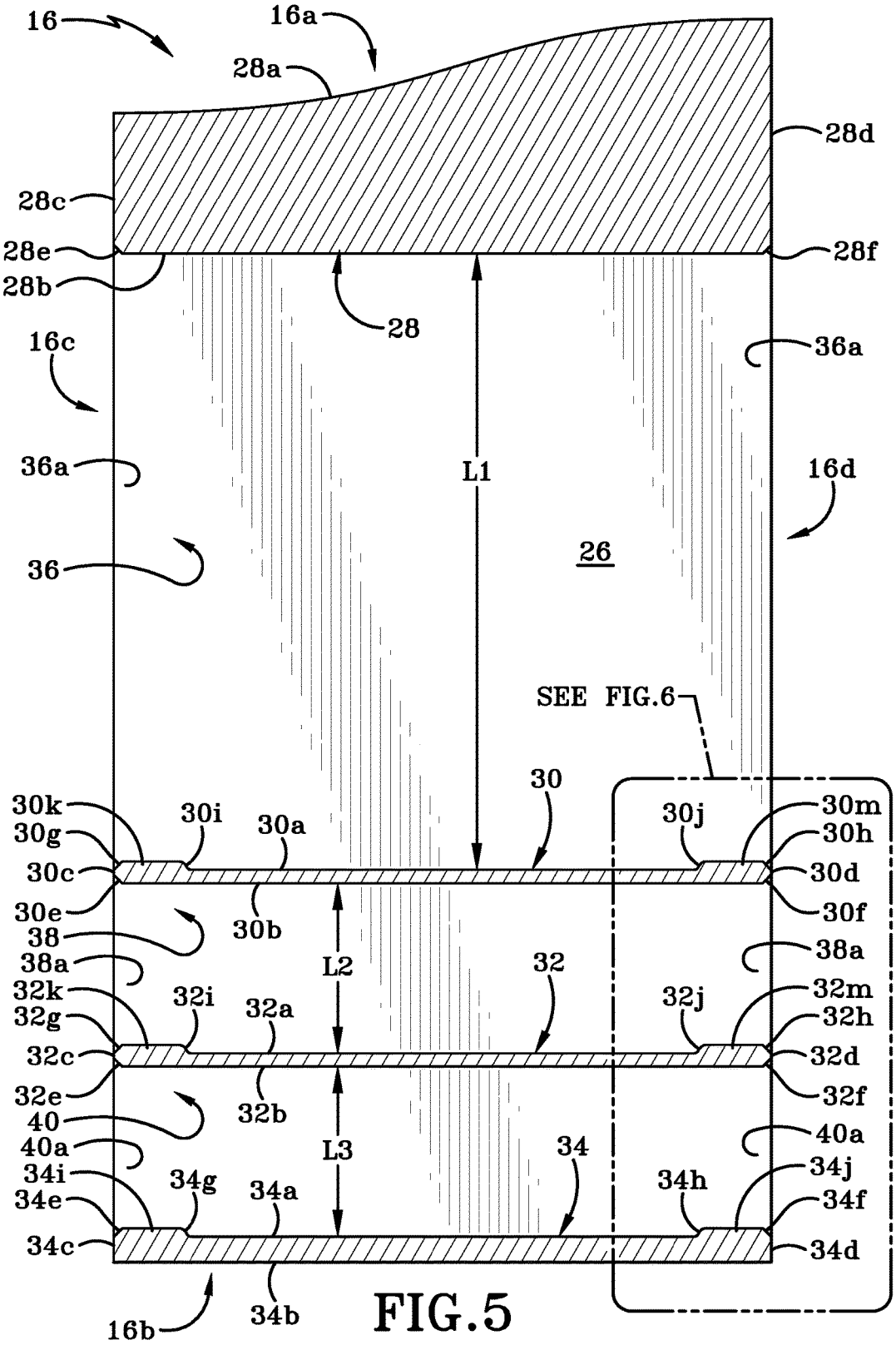
FIG. 5 is a longitudinal cross-section of the holder taken along line 5-5 of FIG. 4.

FIG. 5 shows the rear wall 26 with the first, second, third and fourth spacers 28, 30, 32, 34. Each spacer 28-34 is configured to engage a portion of the cards of one of the three sets of cards 18, 20, 22 and to thereby aid in retaining those cards in the associated first, second or third pocket 26, 38, 40.

First spacer 28 has an upper edge 28*a*, a lower edge 28*b*, a first side edge 28*c* and a second side edge 28*d*. Upper edge 28*a* may have any desired configuration. In the instance illustrated in the attached figures, upper edge 28*a* conforms to the upper edges of each of the front and rear walls 24, 26 and is curved. Lower edge 28*b* is substantially flat to accommodate the shape of the upper ends of the cards of the third set of cards 18 that are configured to be received in first pocket 34. A first chamfer 28*e* is provided at the junction of first side 28*c* and lower edge 28*b*. First chamfer 28*e* angles inwardly and downwardly toward the interior of first pocket 34 and away from first side 28*c*. A second chamfer 28*f* is provided at the junction of second side 28*d* and lower edge 28*b*. Second chamfer 28*f* angles inwardly and downwardly toward the interior of first pocket 34 and away from second side 28*c*. The angle of the first and second chamfers 28*e*, 28*f* is such that each of the cards of the first set of cards 18 that are inserted into first pocket 36 will be guided inwardly into first pocket 36.

Second spacer 30 has an upper edge 30*a*, a lower edge 30*b*, a first side 30*c* and a second side 30*d*. Lower edge 30*b* of second spacer 30 is substantially identical to lower edge 28*b* of first spacer 28. Lower edge 30*b* is therefore substantially flat and straight along its length except for a first chamfer 30*e* and a second chamfer 30*f* that are provided at the junction of lower edge 30*b* and first side 30*c* and second side 30*d*, respectively. First and second chamfers 30*e*, 30*f* are provided to aid in guiding cards from the second set of cards 20 into second pocket 38. Upper edge 30*a* of second spacer 30 also includes a first chamfer 30*g* at the junction of upper edge 30*a* and first side 30*c* and a second chamfer 30*h* at the junction of upper edge 30*a* and second side 30*d*. First chamfer 30*g* is angled in the opposite direction to first chamfer 30*e* and second chamfer 30*h* is angled in the opposite direction to second chamfer 30*f*. First and second chamfers 30*g*, 30*h* are provided to guide cards from the second set of cards 20 into second pocket 38.

Figure 6:
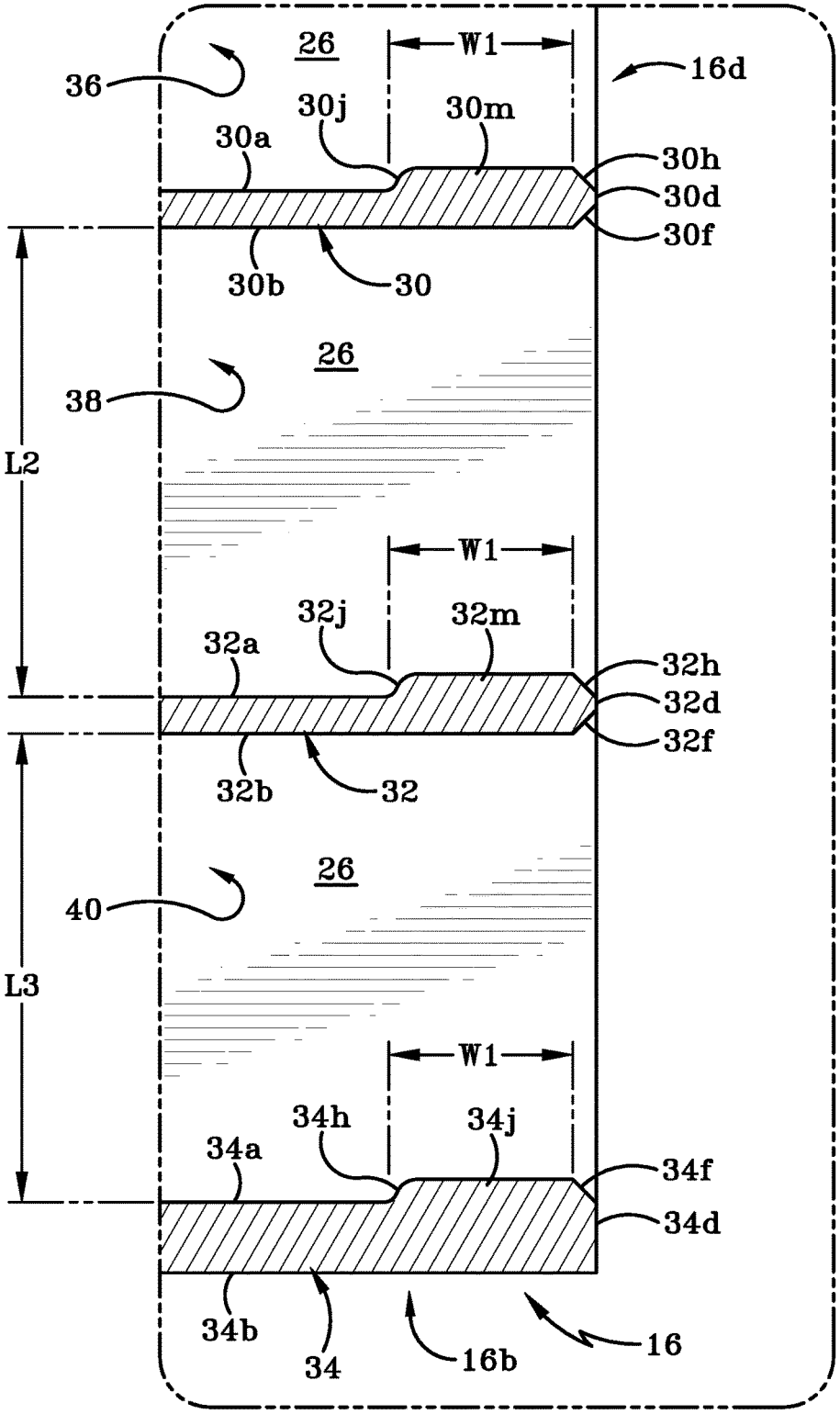
FIG. 6 is an enlargement of the highlighted region of FIG. 5.

In addition to the first and second chamfers 30*g*, 30*h*, upper edge 30*a* also defines a recessed region therein that has a first curved shoulder 30*i* at one end and a second curved shoulder 30*j* at the other end. First curved shoulder 30*i* is oriented at an angle opposite to that of first chamfer 30*g* and second curved shoulder 30*j* is oriented at an angle opposite to that of second chamfer 30*h*. Thus a pair of projections 30*k* and 30*m* extends upwardly into first pocket 36 as is shown in FIG. 5. Projections 30*k*, 30*m* may be of a width "W1" (FIG. 6). Projections 30*k* and 30*m* and the shoulders associated therewith, namely 30*i* and 30*j*, limit the lateral travel of the cards of the first set of cards 18 received in first pocket 36. This will be described later herein.

Third spacer 32 is substantially identical in structure and function to second spacer 30 and therefore will not be described in any additional detail other than to say that third spacer 32 has an upper edge 32*a*, a lower edge 32*b*, a first side 32*c* and a second side 32*d*. Third spacer also includes a first chamfer 32*e*, a second chamfer 32*f*, another first chamfer 32*g*, and another second chamfer 32*h*, a first shoulder 32*i*, a second shoulder 32*j*, a first projection 30*k* and a second projection 32*m*. First and second chamfers 30*e*, 30*f* aid in guiding cards from the third set of cards 22 into third pocket 40 and first and second chamfers 32*g*, 32*h* aid in guiding cards from the second set of cards 20 into second pocket 38. Projections 32*k*, 32*m* may be of a width "W1" (FIG. 6). Projections 32*k* and 32*m* and the shoulders associated therewith, namely 32*i* and 32*j*, limit the lateral travel of cards 20 received in second pocket 38. This will be described later herein.

Fourth spacer 34 has an upper edge 34*a*, a lower edge 34*b*, a first side 34*c* and a second side 34*d*. Lower edge 34*b* is substantially flat and straight from first side 34*c* to second side 34*d*. Upper edge 34*a* is substantially similarly shaped to upper edges 30*a* and 32*a*. Upper edge 34*a* includes a first chamfer 34*e* at the junction of first side 34*c* and upper edge 34*a* and a second chamfer 34*f* at the junction of second side 34*d* and upper edge 34*a*. First and second chamfer's 34*e*, 34*f* angle inwardly and upwardly away from first and second sides 34*c*, 34*d* and into third pocket 40. First and second chamfer's 34*e*, 34*f* aid in directing cards from the third set of cards 22 into third pocket 40.

Upper edge 34*a* further comprises a recessed region and a first shoulder 34*g* is provided at one end of the recessed region and a second shoulder 34*h* is provided at the opposite end of the recessed region. A first projection 34*i* is defined between first chamfer 34*e* and first shoulder 34*g* and a second projection 34*j* is defined between second chamfer 34*f* and second shoulder 34*h*. Projections 34*i* and 34*j* may be of a width "W1" (FIG. 6). Projections 34*i* and 34*j* and the shoulders associated therewith, namely 34*g* and 34*h*, limit the lateral travel of cards 22 received in third pocket 40. This will be described later herein.

Figure 7:
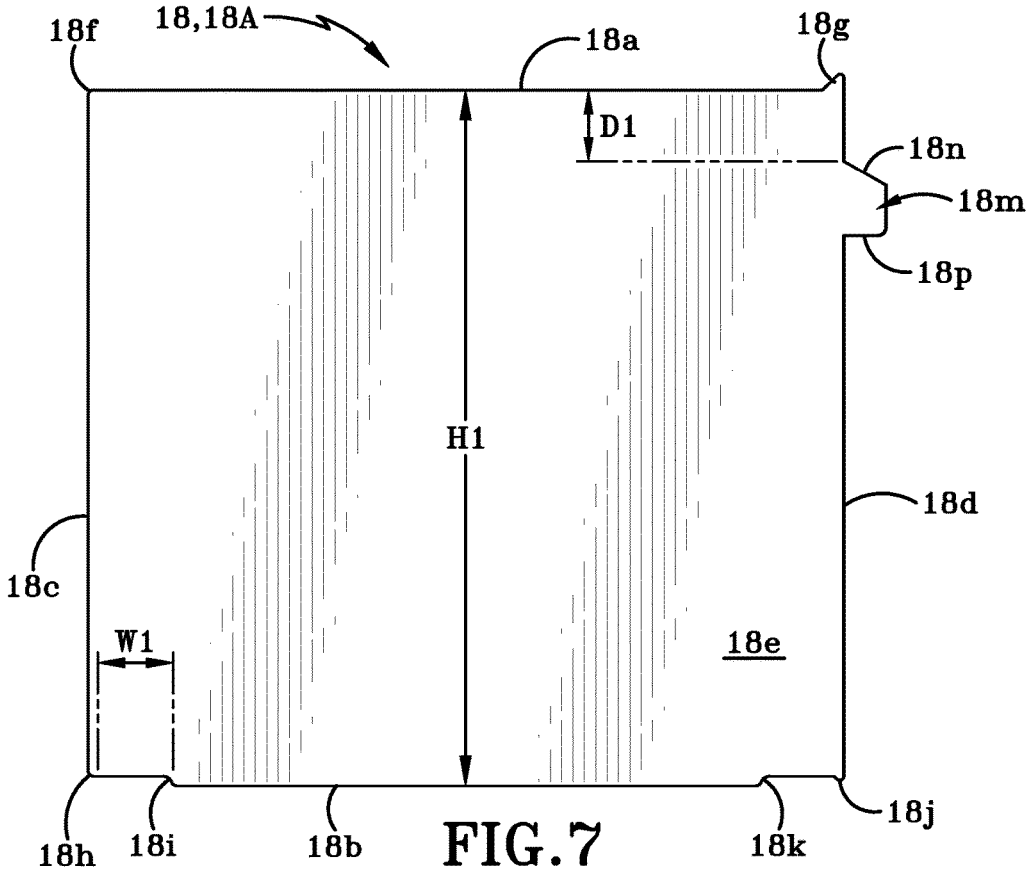
FIG. 7 is a front elevation view of a first display card.

FIG. 7 shows one card 18A from the first set of cards 18. All of the cards 18A-18F of the first set of cards 18 are substantially identical except for one region thereof. This exception will be described later herein. Card 18A has an upper edge 18*a*, a lower edge 18*b*, a first side 18*c*, a second side 18*d*, and a front surface 18*e* (a rear surface is located opposite front surface 18*e* but is not illustrated herein). Upper edge 18*a* meets first side 18*b* at a first corner 18*f*. First corner 18*f* is gently rounded. Upper edge 18*a* meets second side 18*d* at a second corner 18*g*. Second corner 18*g* is shaped as a triangular projection that extends upwardly beyond the rest of upper edge 18*a*. This triangular projection acts as a limiting member that engages a portion of the housing 16 and limits the degree to which card 18A may be inserted into first pocket 36, i.e., how far the card 18A may slide into first pocket 36. First card 18A may be of a height "H1" (FIG. 7)

defined as the distance between upper edge 18*a* and lower edge 18*b*. Height "H1" may be shorter than length "L1" of first pocket 36.

Lower edge 18*b* meets first side 18*c* at a third corner 18*h* that is gently rounded in a similar fashion to first corner 18*f*. Third corner 18*h* is part of a recessed region on lower edge 18*b* that is complementary in shape to first projection 30*k* on second spacer 30. A first shoulder 18*i* is provided a distance inwardly from third corner 18*h* and first shoulder is complementary to first shoulder 30*i* on second spacer 30. Lower edge 18*b* meets second side 18*d* at a fourth corner 18*j*. The fourth corner 18*j* includes a small rounded projection that is positioned and sized to engage second chamfer 30*h* on second spacer 30. The small rounded projection is also a limiting member that limits the extent or degree to which card 18A may move or travel into first pocket 36. Fourth corner 18*j* is part of a second recessed region on lower edge 18*b*. A second shoulder 18*k* is provided a distance inwardly from fourth corner 18*j* and is complementary to second shoulder 30*j* on second spacer 30. First and second recessed regions on lower edge 18*b* may each be of a width "W1" (FIG. 7).

A tab 18*m* extends outwardly away from second side 18*d*. Tab 18*m* is located a distance "D1" from upper edge 18*a* and includes a first end 18*n* that slopes downwardly away from second side 18*d* in a direction extending away from upper edge 18*a*. Tab 18*m* also includes a second end 18*p* that is oriented generally at right angles to second side 18*d*. As indicated earlier herein, all of the cards 18A-18F are substantially identical except in one aspect. That aspect is that the location of the tab 18*m* on each card is a different distance away from upper edge 18*a* of the associated card. This can be seen in FIGS. 2 and 14, for example. The first tab 18*m* on the first card 18A is located a distance "D1" (FIGS. 7 and 14A) from upper edge 18*a* of that card. The first tab 18*m* on the second card 18B is located a distance "D3" (FIG. 14A) from upper edge 18*a*; the third tab 18*m* on third card 18C is located a distance "D4" from upper edge 18*a*. The configuration of tabs 18*m* and the differing distances of tabs 18*m* from upper edge 18*a* all ensure that a region of each tab 18*m* is always visible to a viewer, no matter what order cards 18A-18F are arranged in. Additionally, each tab 18*m* includes information text or informational images 46 (FIG. 46) thereon. In accordance with an aspect of the invention, text or images 46 is oriented at an angle that is substantially parallel to the angled first end 18*n* of tab 18*m*. Text or images 46 is also spaced a distance downwardly from first end 18*n* so that when cards 18A-18F overlap each other the text or images 46 on each and every tab 18*m* remains readable, no matter the physical order of the cards 18A-18F in first pocket 36.

Figure 8:
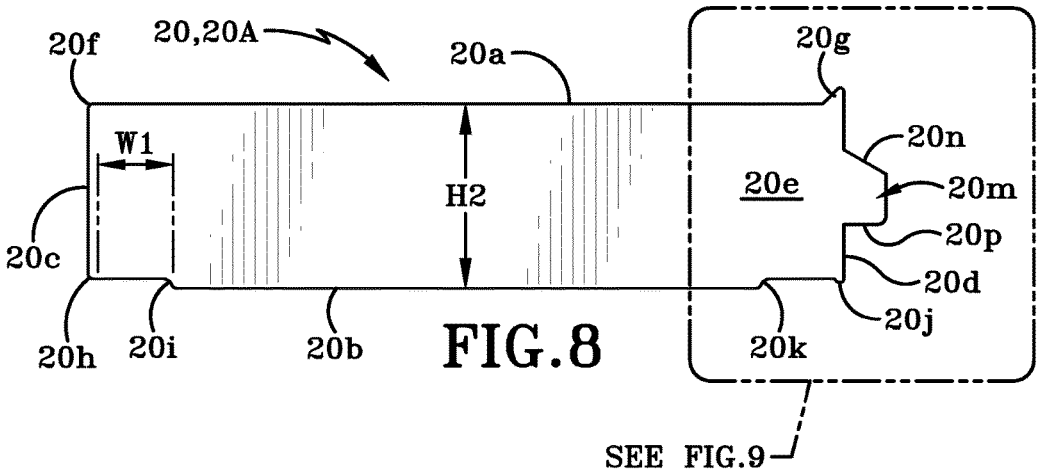
FIG. 8 is a front elevation view of a second display card.
Figure 9:
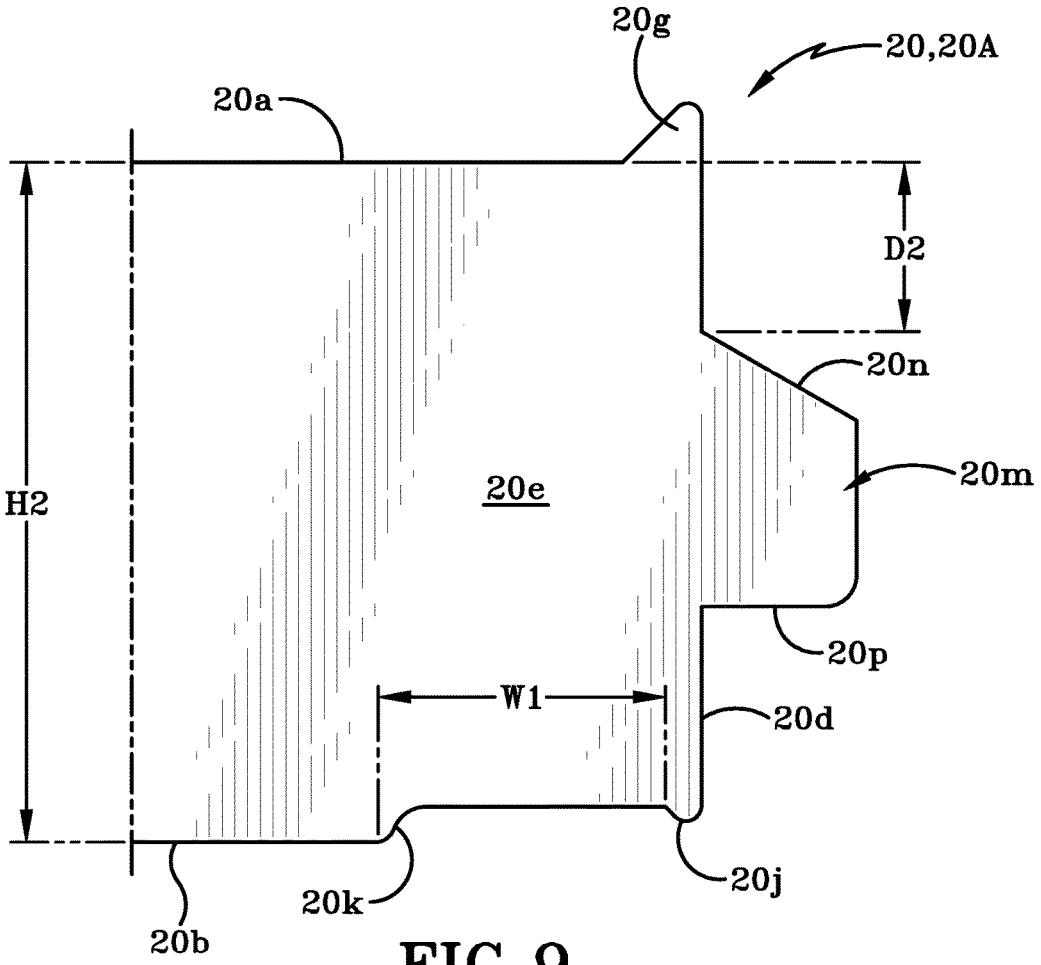
FIG. 9 is an enlargement of the highlighted region of FIG. 8.

FIGS. 8 and 9 show one card 20A from the second set of cards 20. All of the cards 20A-20F in the second set of cards 20 are substantially identical to each other. Card 20A has an upper edge 20*a*, a lower edge 20*b*, a first side 20*c*, a second side 20*d*, and a front surface 20*e* (a rear surface is located opposite front surface 20*e* but is not illustrated herein). Card 20A may be of a height "H2" (FIG. 8) defined as the distance between upper edge 20*a* and lower edge 20*b*. Height "H2" is shorter than length "L2" of second pocket 38.

Upper edge 20*a* meets first side 20*b* at a first corner 20*f*. First corner 20*f* is gently rounded. Upper edge 20*a* meets second side 20*d* at a second corner 20*g*. Second corner 20*g* is shaped as a triangular projection that extends upwardly beyond the rest of upper edge 20*a*. Second corner 20*g* acts as a limiting member that halts the travel of display card 20A into second pocket 38 when second corner 20*g* encounters second chamber 30*f* on second spacer 30.

Lower edge 20*b* meets first side 20*c* at a third corner 20*h* that is gently rounded in a similar fashion to first corner 20*f*. Third corner 20*h* is part of a recessed region on lower edge 20*b* that is complementary in shape to first projection 32*k* on third spacer 32. A first shoulder 20*i* is provided a distance inwardly from third corner 20*h* and first shoulder 20*i* is complementary to first shoulder 32*i* on third spacer 32. (First shoulder 32*i* is a limiting member that limits the degree to which card 20A can travel into the second pocket 38.) Lower edge 20*b* meets second side 20*d* at a fourth corner 20*j*. The fourth corner 20*j* includes a small rounded projection that is positioned and sized to engage second chamfer 32*h* on third spacer 32. Fourth corner 20*j* is part of a second recessed region on lower edge 20*b*. A second shoulder 20*k* is provided a distance inwardly from fourth corner 20*j* and is complementary to second shoulder 32*j* on third spacer 32. First and second recessed regions may be of a width "W1" (FIG. 8).

A tab 20*m* extends outwardly away from second side 20*d*. Tab 20*m* is located a distance "D2" from upper edge 20*a* and includes a first end 20*n* that slopes downwardly away from second side 20*d* in a direction extending away from upper edge 20*a*. Tab 20*m* also includes a second end 20*p* that is oriented generally at right angles to second side 20*d*. When a plurality of cards 20A-20F are stacked one-in-front of the other to form the second set of cards 20, all of the tabs 20*m* are aligned with each other instead of being staggered. Only the tab 20*m* of the outermost card is visible from the front and the rest of the tabs 20*m* are stacked one behind the other.

Figure 10:
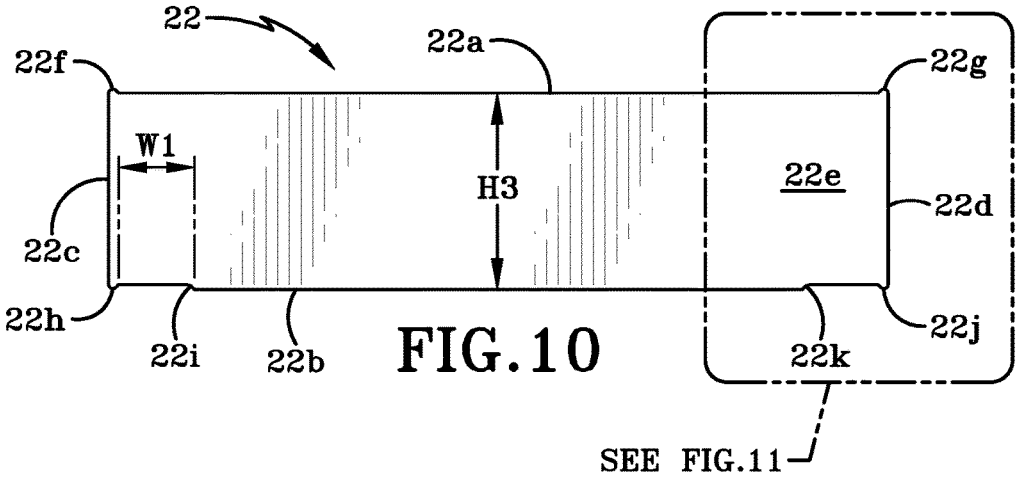
FIG. 10 is a front elevation view of a third display card.
Figure 11:
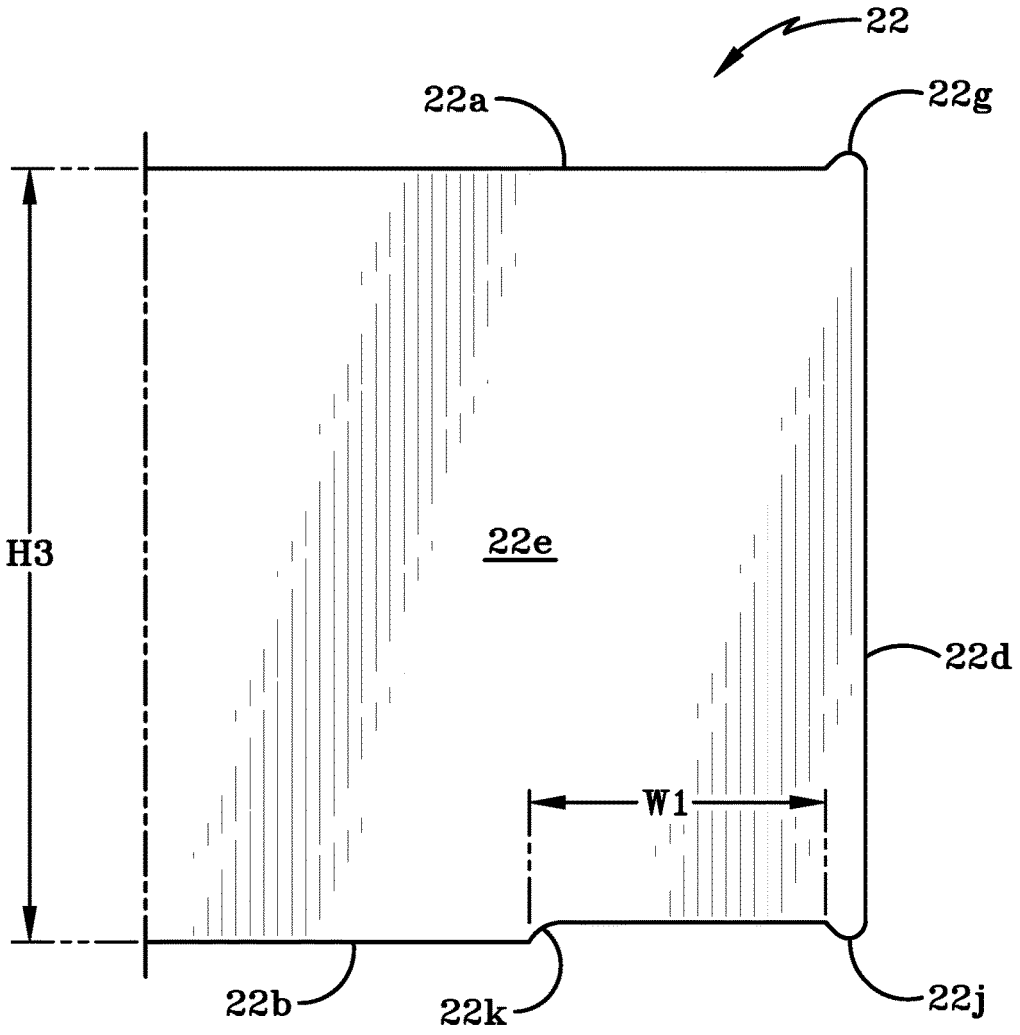
FIG. 11 is an enlargement of the highlighted region of FIG. 10.

FIGS. 10 and 11 show the third card 22. Card 22 has an upper edge 22*a*, a lower edge 22*b*, a first side 22*c*, a second side 22*d*, and a front surface 22*e* (a rear surface is located opposite front surface 22*e* but is not illustrated herein). Card 22 may be of a height "H3" defined as the distance between upper edge 22*a* and lower edge 22*b*. Height "H3" may be shorter than length "L3" of third pocket 40.

Upper edge 22*a* meets first side 22*b* at a first corner 22*f*. First corner 22*f* is a gently rounded projection that extends upwardly and outwardly from upper edge 22*a*. Upper edge 22*a* meets second side 22*d* at a second corner 22*g*. Second corner 22*g* is again a gently rounded projection that extends upwardly and outwardly beyond the rest of upper edge 22*a*, except for the projection of first corner 22*f*. First and second corners 22*f*, 22*g* may be of substantially the same size.

Lower edge 22*b* meets first side 22*c* at a third corner 22*h* that is a gently rounded projection that is similar to first corner 22*f* except the projection extends outwardly and downwardly from lower edge 22*b*. Third corner 22*h* is part of a first recessed region on lower edge 22*b* that is generally complementary in shape to first projection 34*i* on fourth spacer 30. A first shoulder 22*i* is provided a distance inwardly from third corner 22*h* and first shoulder 22*i* is complementary to first shoulder 34*g* on fourth spacer 34. Lower edge 22*b* meets second side 22*d* at a fourth corner 22*j*. The fourth corner 22*j* includes a small rounded projection that extends downwardly and outwardly from lower edge 22*b* and is positioned and sized to engage second chamfer 34*f* on fourth spacer 34. Fourth corner 22*j* may be of substantially the same shape and size as the projection of third corner 22*h*. Fourth corner 22*j* is part of a second recessed region on lower edge 22*b*. A second shoulder 22*k* is provided a distance inwardly from fourth corner 22*j* and is complementary to second shoulder 34*h* on fourth spacer 34. First and second recessed regions may be of a width "W1" (FIG. 10). It should be noted that no tab extends outwardly from either of the first and second sides 22*c*, 22*d* of third card 22.

Figure 12:
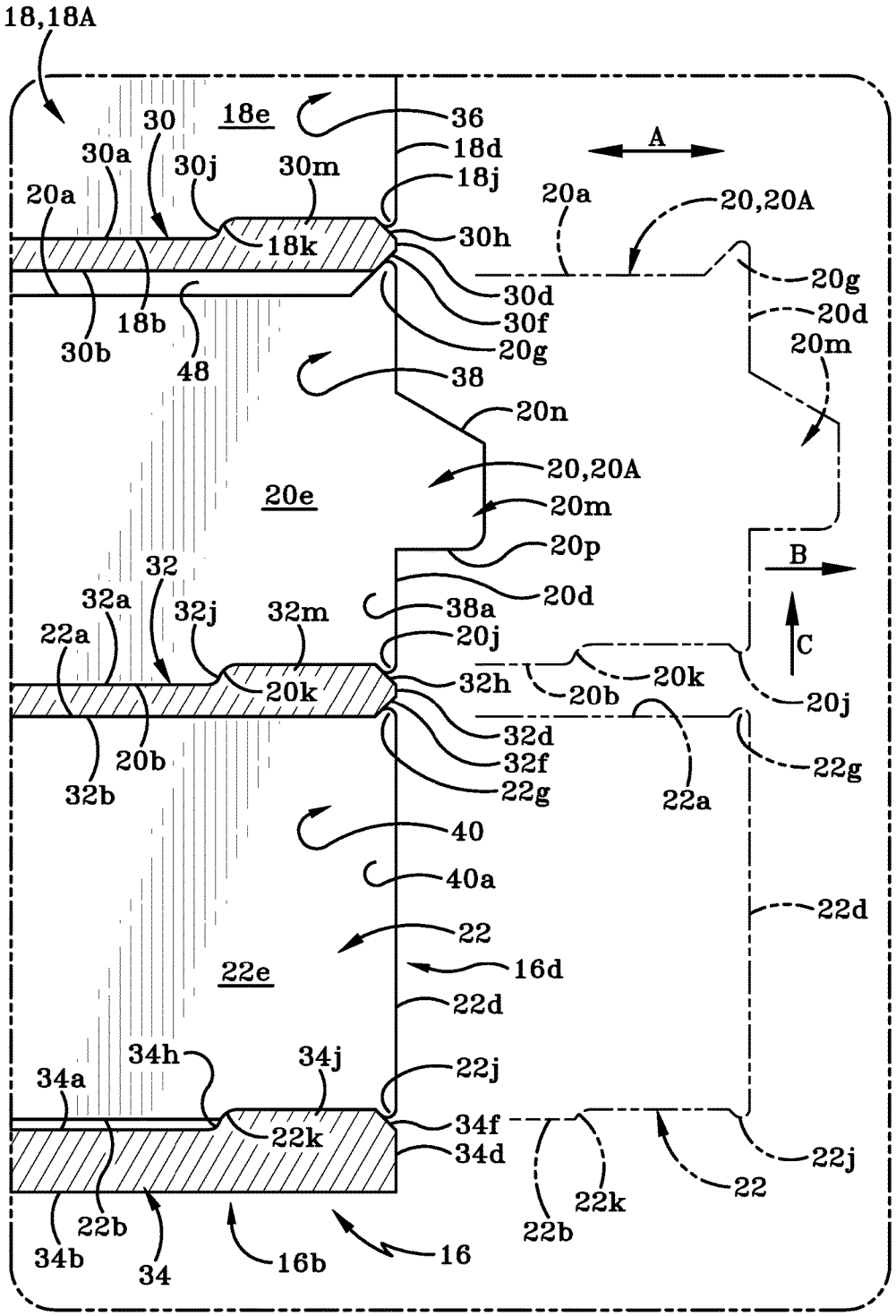
FIG. 12 is a partial longitudinal cross-section of the holder shown in FIG. 5 but with the first, second, and third display cards engaged therewith and showing, in phantom, the second and third display cards partially inserted into the holder.

FIG. 12 shows cards 18A, 20A and 22 engaged in housing 16. The rear wall (26) has been removed from this figure for clarity of illustration. Card 18A is engaged in first pocket 36 and there is a type of interlocking engagement of second shoulder 30*j* on second spacer 30 and second shoulder 18*k* on card 18A. (Although not illustrated in FIG. 12, there is a similar interlocking engagement of first shoulder 30*i* on second spacer 30 and first shoulder 18*i* of card 18A.) This interlocking engagement restricts the movement of card 18A in a lateral direction indicated by arrow "A" in this figure. Furthermore, the projection 18*j* on card 18A abuts second chamfer 30*f*. Second chamfer 30*f* acts a stop for movement of the card toward first side 16*c* of housing 16. Although not illustrated in this figure, the triangular projection 18*g* (FIG. 7) on card 18A will come into contact with second chamfer 28*f* on first spacer 28. This engagement of projection 18*g* and second chamfer 28*f* also prevents further movement of card 18A toward first side 16*c* of housing 16.

FIG. 12 also shows card 20A engaged in second pocket 38. Again, there is interlocking engagement of card 20A and third spacer 32. In particular, shoulders 20*k* on card 20A and 32*g* on third spacer 32 are in abutting contact (as are the shoulders 20*i* and 32*i*); triangular projection 20*g* abuts second chamfer 30*f* on second spacer 30 and projection 20*j* on card 20A abuts second chamfer 32*f* on third spacer 32. It should be noted that when card 20A is engaged in second pocket 38, a gap 48 is defined between upper edge 20*a* of card 20A and lower edge 30*b* of second spacer 30. (A similar gap is defined between upper edge 18*a* of card 18A and lower edge 28*b* of first spacer 28.)

In order to remove card 20A from its interlocking engagement in second pocket 38, tab 20*m* is pulled in the direction of arrow "B". This motion causes second shoulder 20*k* of card 20A to ride upwardly along second shoulder 32*g* thereby causing card 20A to move upwardly in the direction of arrow "C" (FIG. 12). When in this raised position, upper edge 20*a* of card 20A is proximate lower edge 30*b* of second spacer 30 and card 20A. In other words, the gap 48 is closed and card 20A is then free to be withdrawn from second pocket 38. When card 20A is inserted into second pocket 38, the opposite motion of card 20A occurs. Card 20A is introduced into second pocket 38 and moved in the opposite direction to arrow "B" and further into second pocket 38, the upper edge 20*a* thereof slides along lower edge 30*b* of second spacer 30 until second shoulder 20*k* slides downwardly along second shoulder 32*g* of third spacer 32. Card 20A then drops downwardly in the opposite direction of arrow "C" and gap 48 once again opens up. It should be noted that card 18A experiences the same types of changes in vertical position relative to the lower edge 28*b* of first spacer 28 when card 18A is inserted or removed from housing 16.

Cards 18 and 20 are considered to be readily changeable cards and are configured to be relatively easily inserted and removed from housing 16. Card 22, on the other hand, is configured so that it is relatively permanently engaged in housing 16. It is not contemplated that card 22 will be changed frequently. In order to aid in ensuring that card 22 remains substantially permanently engaged in housing 16 and is not accidentally withdrawn therefrom, card 22 does not include a tab similar to tabs 18*n* or 20*n*. Furthermore, card 22 is of a substantially similar size relative to third pocket 40, i.e., the height "H3" of card 22 is substantially similar to the length "L3" of third pocket 40. Consequently, when card 22 is inserted into third pocket 40 the card 22 slides over the uppermost surface of projection 34*j* and when shoulder 22*k* of card 22 slides down shoulder 34*h* of fourth spacer 34, card 22 becomes substantially wedged between shoulder 34*g* and shoulder 34*h*. If a person tried to remove card 22, it can be done, but card 22 is reasonably difficult to grab hold of and has to be slightly deformed in order to withdraw it from third pocket 40.

It will be understood that first, second and third pockets 36, 38, 40 may be sized differently to what has been illustrated herein. So, for instance, first pocket 36 may be of a size that is closer to second pocket 38 or third pocket 40; and one or the other of second pocket 38 and third pocket 40 may be larger than is illustrated herein. It will be understood that the size of the cards 18, 20, 22 that are to be received in the differently sized first, second or third pockets 36, 38, 40, will be changed to be complementary to the pocket into which a particular card is to be received.

Figure 13:
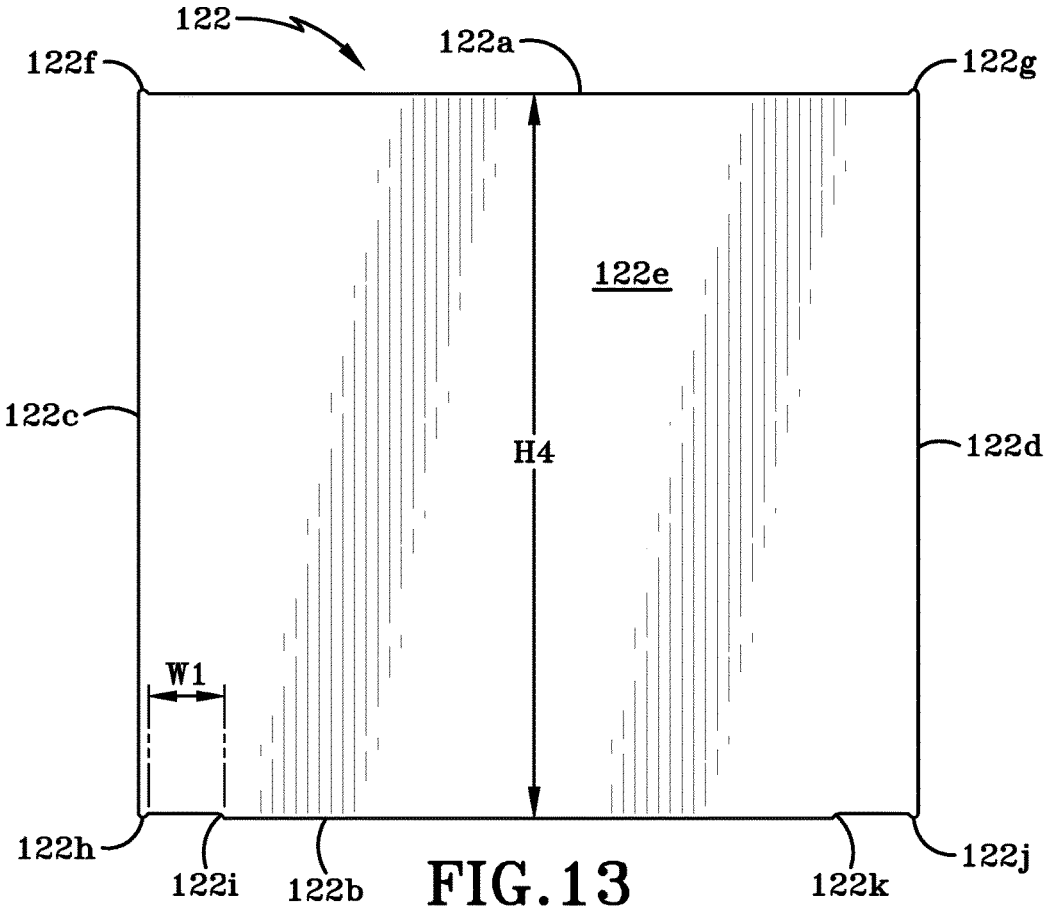
FIG. 13 is a front elevation of an alternative embodiment of the first display card.

So, for example, FIG. 13 shows a second embodiment of a card that is to be received in a differently sized third pocket. This card 122 is configured as a semi-permanent card. Card 122 includes all of the features of card 22 but is of a height "H4" instead of a height "H3". Card 122 has an upper edge 122*a*, a lower edge 122*b*, a first side 122*c*, a second side 122*d*, and a front surface 122*e* (a rear surface is located opposite front surface 122*e* but is not illustrated herein). Upper edge 122*a* meets first side 122*b* at a first corner 122*f*. First corner 122*f* is a gently rounded projection that extends upwardly and outwardly from upper edge 122*a*. Upper edge 122*a* meets second side 122*d* at a second corner 122*g*. Second corner 122*g* is again a gently rounded projection that extends upwardly and outwardly beyond the rest of upper edge 122*a*, except for the projection of first corner 122*f*. First and second corners 122*f*, 122*g* may be of substantially the same size.

Lower edge 122*b* meets first side 122*c* at a third corner 122*h* that is a gently rounded projection that is similar to first corner 122*f* except the projection extends outwardly and downwardly from lower edge 122*b*. Third corner 122*h* is part of a first recessed region on lower edge 122*b* that is generally complementary in shape to first projection 34*i* on fourth spacer 30. A first shoulder 122*i* is provided a distance inwardly from third corner 122*h* and first shoulder 122*i* is complementary to first shoulder 34*g* on fourth spacer 34. Lower edge 122*b* meets second side 122*d* at a fourth corner 122*j*. The fourth corner 122*j* includes a small rounded projection that extends downwardly and outwardly from lower edge 122*b* and is positioned and sized to engage second chamfer 34*f* on fourth spacer 34. Fourth corner 122*j* may be of substantially the same shape and size as the projection of third corner 122*h*. Fourth corner 122*j* is part of a second recessed region on lower edge 122*b*. A second shoulder 122*k* is provided a distance inwardly from fourth corner 122*j* and is complementary to second shoulder 34*h* on fourth spacer 34. First and second recessed regions may be of a width "W1". It should be noted that no tab extends outwardly from either of the first and second sides 122*c*, 122*d* of third card 22.

Figure 14:
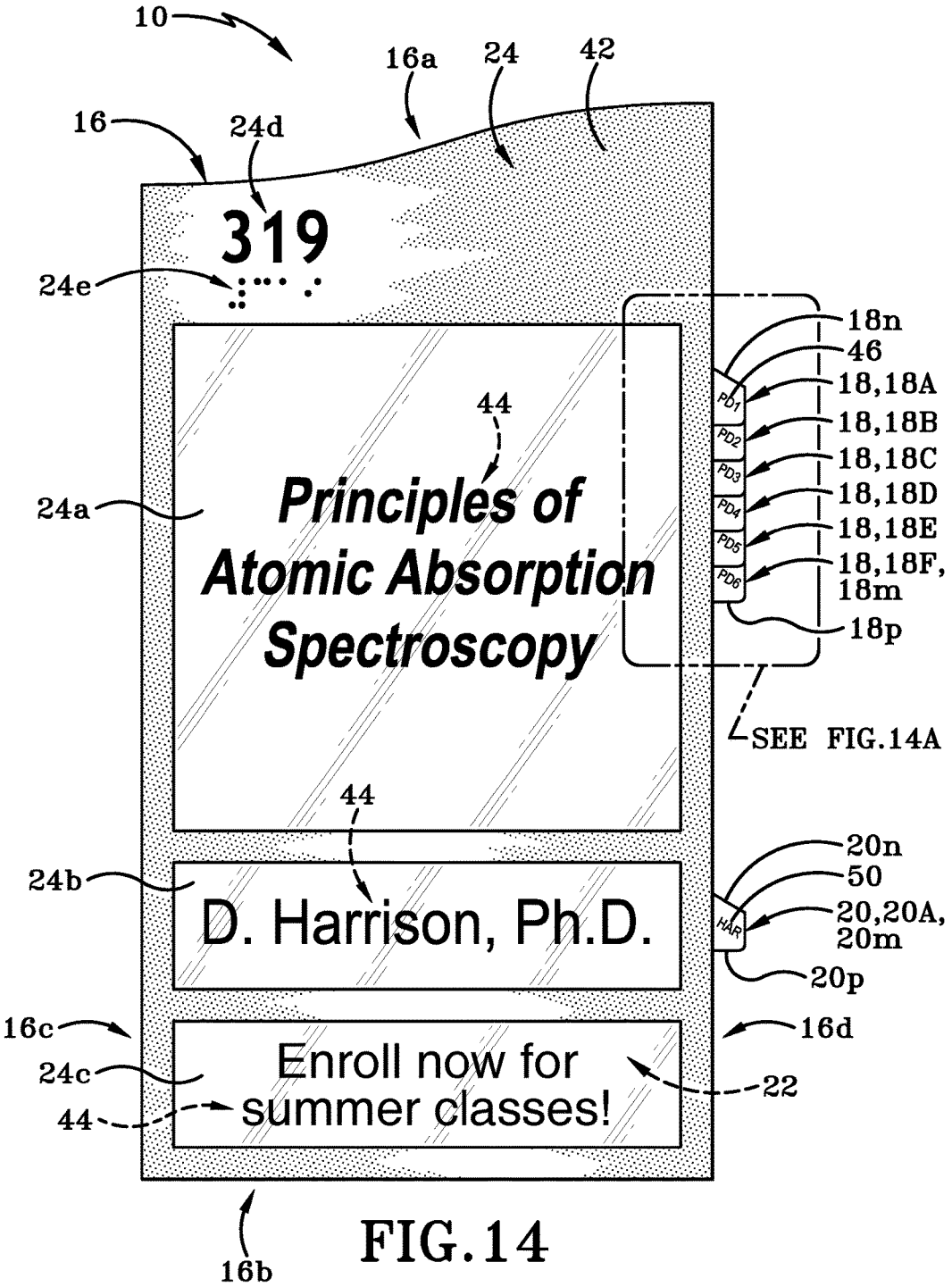
FIG. 14 is a front elevation view of the changeable sign showing a set of display cards engaged in the holder and showing a first set of information on the first, second and third display cards.
Figure 14A:
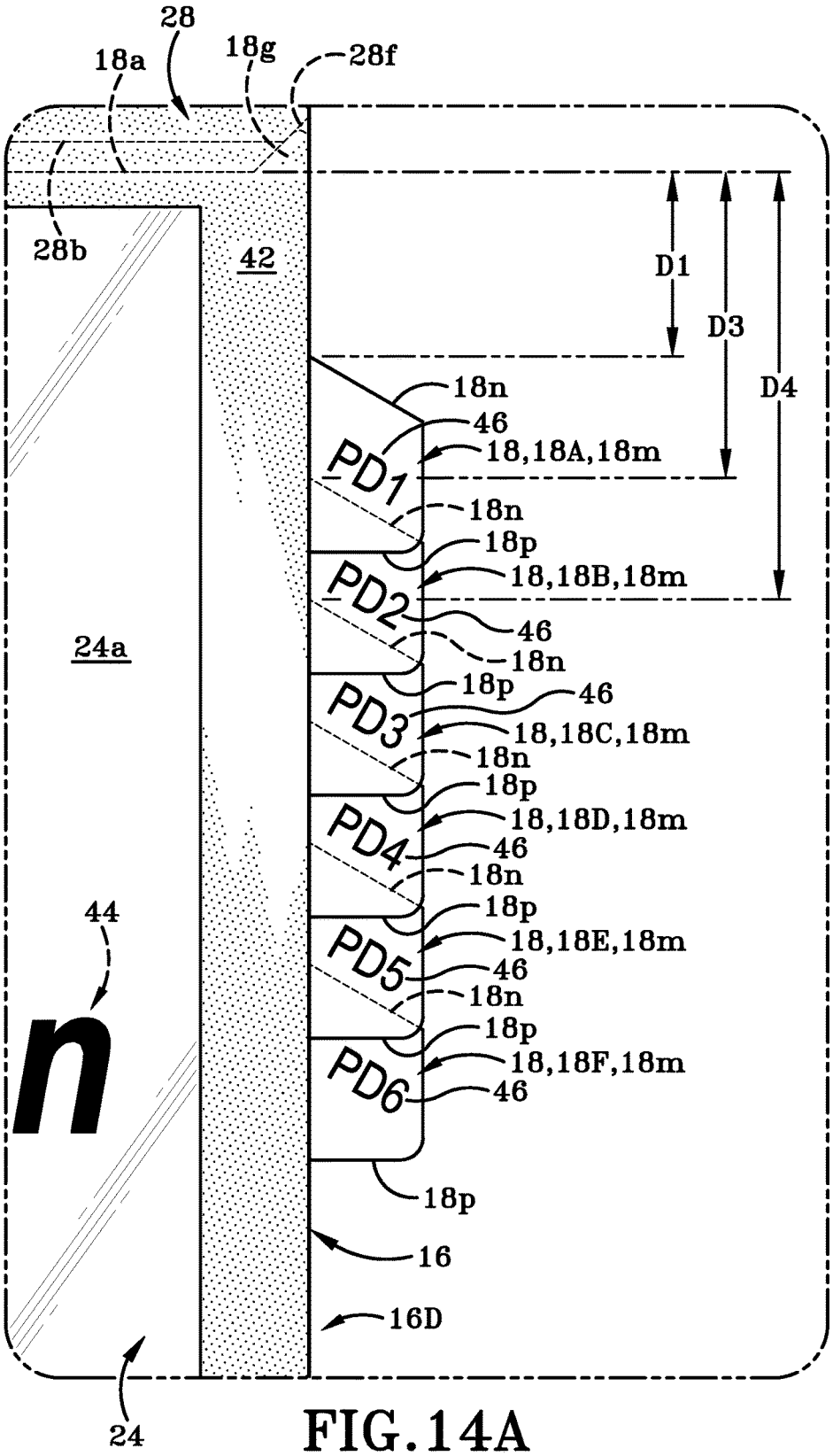
FIG. 14A is an enlargement of the highlighted region of FIG. 14 showing the arrangement of the tabs on the cards of the first set of cards.
Figure 15:
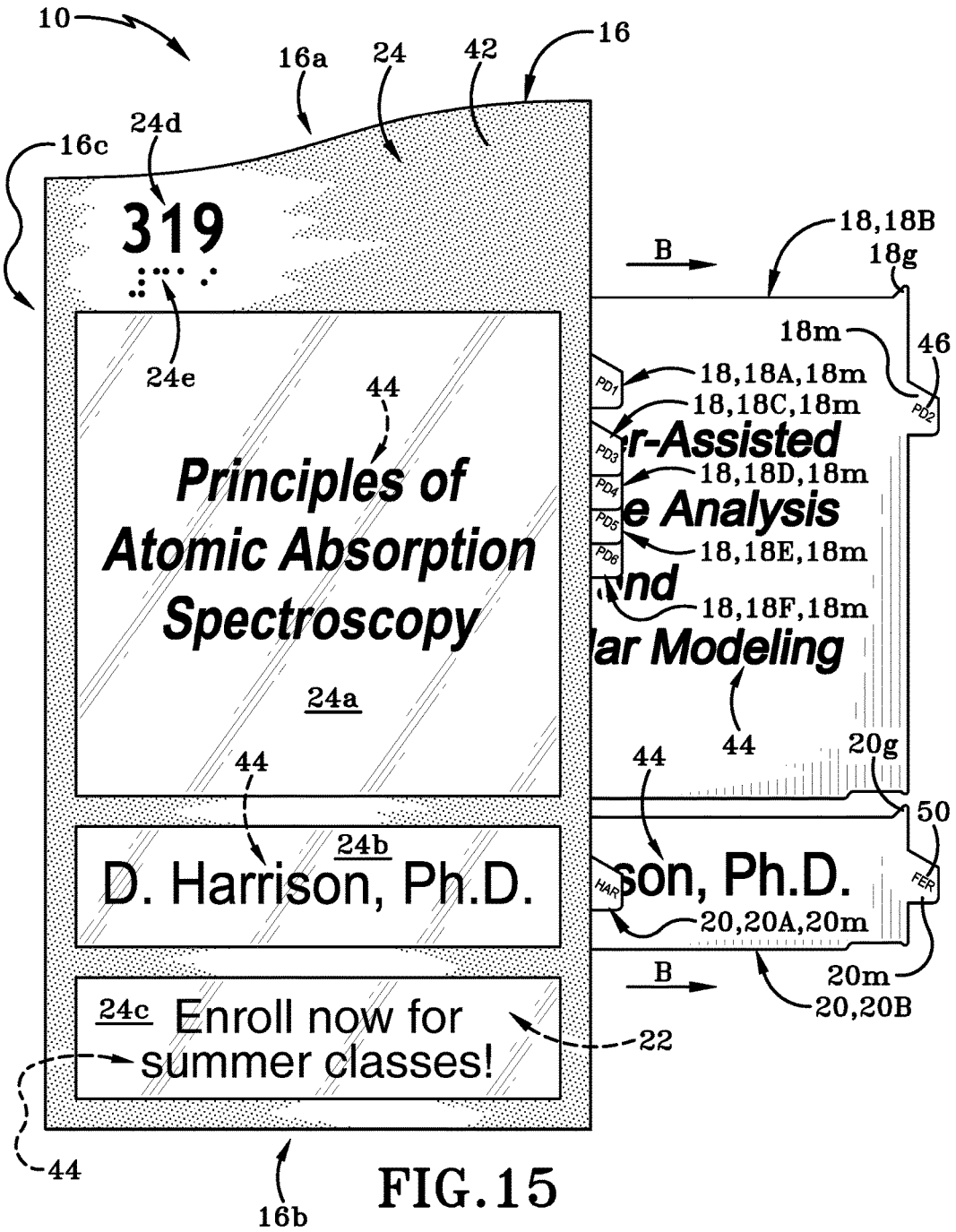
FIG. 15 is a front elevation view of the changeable sign showing the first and second cards being withdrawn from the holder and the third card remaining engaged with the holder.
Figure 16:
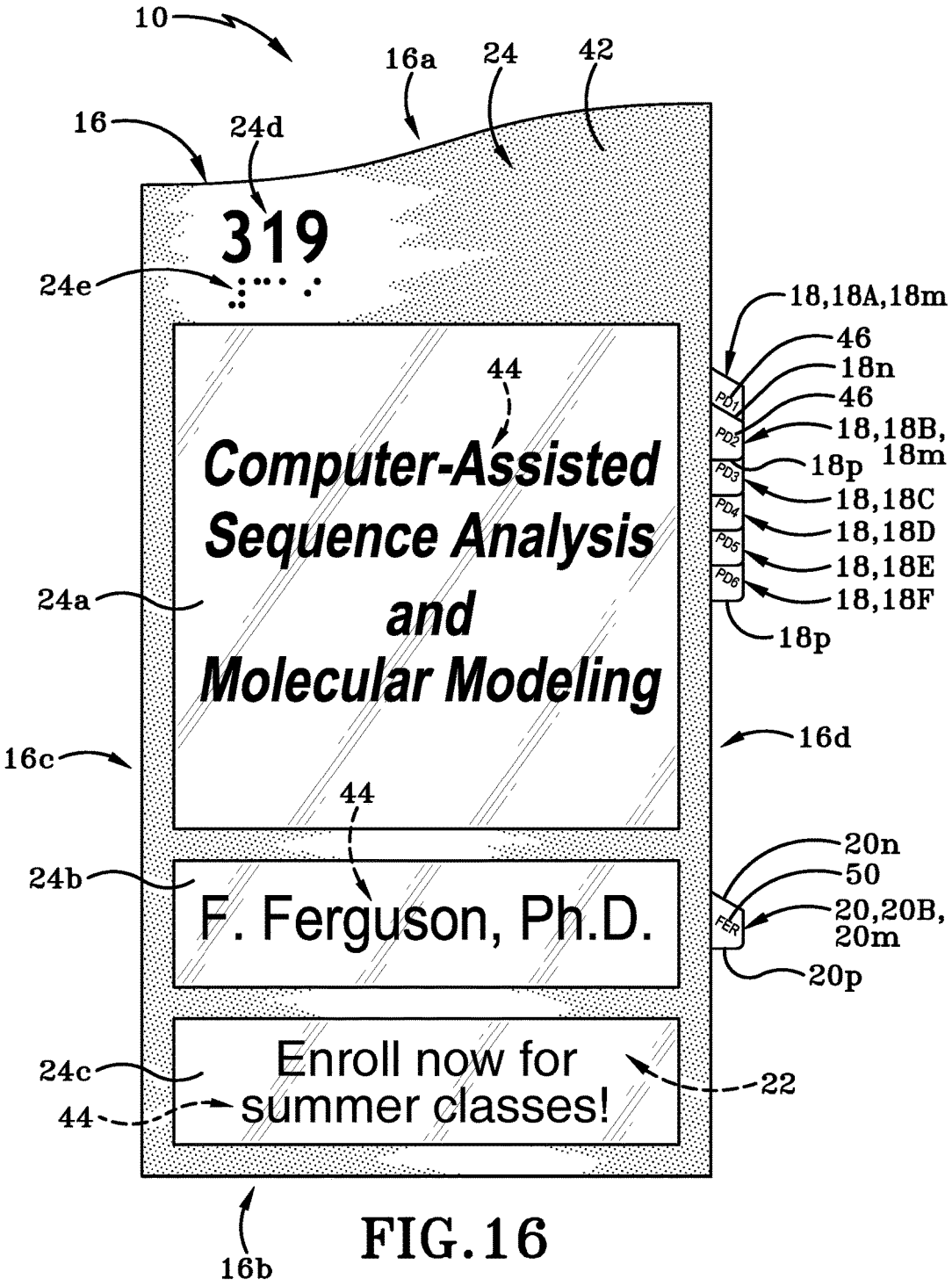
FIG. 16 is a front elevation view the changeable sign showing new first and second cards engaged in the holder to display new information.

FIGS. 14-16 illustrate cards 18A and 20A being replaced with cards 18B and 20B. Display sign 10 is illustrated as having the graphic and/or textual information 44 on first card 18A visible through first window 24*a* on housing and the graphic and/or textual information 44 on second card 20A visible through second window 24*b*. The graphic or textual information 44 on third card 22 is visible through third window 24*c*. FIG. 14 shows that the various tabs of the plurality of cards 18 retained within the first pocket of housing 16 can be readily seen since they project outwardly beyond second side 16*d* of housing 16. As discussed earlier herein, tabs 18*n* of the various cards 18A-18B have informational text or images 46 thereon and this text is oriented at an angle. Furthermore, no text 46 is provided on regions of the tabs 18*n* that are covered by another of the tabs. It is therefore easy for a user to determine which card 18 to remove from first pocket 36 and insert in front of card 18A. So, for example, the user may select card 18B (FIG. 15) and withdraw the same from housing 16 in the direction of arrow "B" and then insert card 18B into the first pocket 36 and in front of card 18A. This insertion occurs in the direction of arrow "D" (FIG. 16).

The user may also determine that the information on card 20A is no longer relevant in light of the change in the card displayed in the first pocket. All of the tabs 20*m* also contact textual or graphic information 50. The tabs 20*m* are illustrated as all being located one-in-front of the other instead of in a staggered fashion as with cards 18. As a result, the user changing the display sign 10 will have to withdraw some or all of the cards 20 or will need to move the tabs 20*m* in such a fashion that they are able to read the informational text 50 on the various tabs 20*m* and select the tab that displays the information they seek. The desired tab 20*m* will be pulled outwardly from housing 16 in the direction of arrow "B" (as is illustrated in FIG. 15) and then that selected card 20B in this instance, will be inserted in front of card 20A in the second pocket 38 of housing 16 and pushed inwardly in the direction of arrow "D" until seated in second pocket 38. As discussed earlier, the second chamfers 30*h* on second spacer 30 and the second chamfer 32*f* on third spacer 32 will limit the extent of travel of the cards 18B and 20B toward first side 16*a* of housing 16.

The information 44 shown on third card 22 remains relevant no matter which of the cards 18A-18F is displayed and no matter which of the cards 20A-20F is displayed. Third card 22 is therefore not withdrawn from housing 16.

It will be understood that instead of cards 18A-18F and 20A-20F being insertable into the pockets through openings in the second side 16*d* of housing 16, cards 18A-18F and 20A-20F may be configured so that the tabs 18*m*, 20*m* thereon extend outwardly from the first sides 18*c*, 20*c* of the cards instead of from the second sides 18*d*, 20*d* thereof. All other structures on cards 18 and 20 will also be reversed so that the travel of the cards toward second side 16*d* of housing can be limited by the various projections on the cards engaging the first chamfers 30*g*, 32*g* on second and third spacers 30, 32.

Furthermore, the tabs 18*m* on cards 18A-18F may not be staggered but may instead be overlapped in a manner similar to the overlapping (i.e. one-in-front of the other) configuration of tabs 20*m*. Similarly, instead of tabs 20*m* overlapping each other as shown herein, tabs 20*m* may be staggered in a similar manner to the illustrated tabs 18*m*. Still further, tabs 18*m*, 20*m* may be provided on each of first and second sides 18*c*, 18*d* and 20*c*, 20*d* of the cards 18, 20. Furthermore, tabs 18*m*, 20*m* may provided on alternating opposite sides of the cards. So, for example, card 18A may have its tab 18*m* extending outwardly from second side 18*d* of the card 18A, while card 18B may have its tab 18*m* extending outwardly from first side 18*c* of that card 18B.

It will be understood that while first window 24*a*, second window 24*b*, and third window 24*c* and the associated first pocket 36, second pocket 38 and third pocket 40 have been disclosed as being positioned one above the other to effectively form a vertical column in housing 16, the windows 24*a*-24*c* and pockets may be located in any desired configuration relative to each other. So, for example, two of the windows and associated pockets may be located side-by-side and the other window and associated pocket may be located above or below the two side-by-side windows and pockets.

It will further be understood that any number of windows and associated pockets may be provided in housing 16. So, for example, only a single window and associated single pocket may be provided in housing; or only two windows and associated pockets may be provided therein or more than three windows and pockets may be provided.

Furthermore, the type of display cards 18, 20, 22 utilized in housing 16 may differ from what has been described herein. Some or all of the cards may be configured to be arranged as a stack or set of display cards that may be individually selectively withdrawn and rearranged within sign 10, in the manner described with reference to cards 18 or 20. Some or all of the cards may be single display cards that are substantially permanently retained within housing 16. Alternatively, only a single display card may be inserted into one of the pockets in housing 16 but that single display card may have the configuration of display card 18 or 20 so that it is readily and easily withdrawn from housing 16.

The changeable sign 10 disclosed herein may be used as follows. The first step if the provision of a sign 10 comprising a housing 16 having a front wall 24 and a rear wall 26; a first pocket 36 defined in housing 16; a first window 24*a* provided on front wall 24, wherein an interior of first pocket 24*a* is visible through the first window 24*a*. The method includes inserting a first set of display cards 18 into first pocket 36; where first set of display cards 18 includes one or more display cards 18A, 18B etc. that have different graphic images or text 44 thereon; positioning an outermost display card (such as 18A) of the one or more display cards 18A-18F adjacent first window 24*a*; displaying the text or graphics 44 on outermost display card 18A through first window 24*a*; selecting another of the one or more display cards, such as 18B, from a remaining portion of first set of display cards 18; removing the selected one of the display cards 18B from first pocket 36; and inserting the removed display card 18B in front of the outermost display card 18A; displaying the text or graphics 44 on the inserted display card 18B through first window 24*a*. 24. It should be noted that display cards 18A-18B in the first set of display cards (and display cards 20A-20F in second set of display cards 20) are selectively individually removable from the first pocket 36 (or second pocket 38) are selectively individually removable and/or insertable into the first pocket 36 (or second pocket 38).

The step of removing the selected one of the display cards 18B includes grasping a tab 18*m* provided on the selected one of the display cards 18B; pulling on the grasped tab (in the direction of arrow "B"—FIG. 15) and sliding the selected one of the display cards 18B out of first pocket 36. The step of providing housing 16 further comprises providing at least one additional pocket 38 or 40 in housing 16; wherein the at least one additional pocket is separated from first pocket 36; providing at least one additional window 24*b* or 24*c*, respectively, on front wall 24 of housing 16; wherein an interior of the at least one additional pocket 38 or 40 is visible through the at least one additional window 24*b* or 24*c*; and the method further comprises selecting one of the at least one additional pockets (40 for example); inserting at least a single display card 22 into the selected one of the at least one additional pockets 40; and semi-permanently interlocking the inserted single display card 22 into the selected one of the at least one additional pockets 40.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example not limited to the exact details shown or described.

The invention claimed is:

1. A changeable sign comprising:

a housing having:

a front wall with an upper edge, a lower edge, a first side and a second side;

a rear wall, with an upper edge, a lower edge, a first side, and a second side;

a first spacer and a second spacer positioned between the front wall and the rear wall, wherein the second spacer is located a distance away from the first spacer;

a pocket defined between an interior surface of the front wall and an interior surface of the rear wall of the housing and between the first spacer and the second spacer;

a window provided on the front wall, wherein an interior of the pocket is visible through the window;

one or more display cards shaped and sized to be received in the pocket, wherein each of the one or more display cards has an upper edge, a lower edge, a first side, and a second side, and wherein each of the one or more display cards has different text or images thereon;

wherein one of the upper edge or the lower edge includes a first limiting member and the other of the upper edge and the lower edge includes a second limiting member; and the first limiting member selectively engages a portion of the housing when an associated display card is inserted into the pocket and the first limiting member limits a degree of insertion of the associated display card into the pocket; wherein the first limiting member engages a region of one of the first spacer and the second spacer; and the second limiting member engages a region on the other of the first spacer and the second spacer and wherein the regions of the one of the first and second spacers engaged by the first limiting member or the second limiting member is a chamfer that angles inwardly toward the interior of the pocket;

a shoulder provided on the lower edge of each of the one or more display cards, said shoulder being located a distance inwardly from one of the first side or the second side of the associated display card; and a shoulder provided on the second spacer, wherein the spacer's shoulder is located a distance inwardly from the chamfer; and wherein the display card's shoulder and the spacer's shoulder are complementary and selectively interlock the associated display card and the housing together; and wherein the one or more display cards form a set of display cards that is receivable in the pocket; and when the set of display cards is so received, the text or images on an outermost display card of the set of display cards is visible through the window.

2. The changeable sign as defined in claim 1, wherein a tab extends outwardly from a side edge of each of the one or more display cards; and when the set of display cards is received in the pocket, the tab of each of the one or more display cards extends outwardly beyond a side edge of the front wall of the housing.

3. The changeable sign as defined in claim 2, wherein the tab of each of the one or more display cards is located at a distance from the upper edge thereof; and wherein the distance of the tab from the upper edge of each of the one or more display cards in the set of display cards differs from the distances of the tabs of all other display cards in the set of display cards.

4. The changeable sign as defined in claim 3, wherein when the set of display cards is received in the pocket, the tabs of all of the one or more display cards in the set of display cards are staggered relative to each other.

5. The changeable sign as defined in claim 4, further comprising text or images provided on each tab; and when the set of display cards is received in the pocket, the text or images on all the tabs is visible no matter an order of the display cards in the set of display cards.

6. The changeable sign as defined in claim 5, wherein the text or images on each tab is oriented at an angle relative to the side edge of an associated one of the one or more display cards from which the tab extends.

7. The changeable sign as defined in claim 1, wherein the first limiting member is located at a junction of the upper edge of the associated display card and one of the first side and the second side thereof; and the first limiting member extends upwardly for a distance beyond the upper edge of the associated display card.

8. The changeable sign as defined in claim 1, wherein the first limiting member is located at a junction of the lower edge of the associated display card and one of the first side and the second side thereof; and the first limiting member extends downwardly for a distance beyond the lower edge of the associated display card.

9. The changeable sign as defined in claim 1, further comprising:

a second pocket defined in the housing, said second pocket being separated from the pocket; and a second window provided on the front wall of the housing, wherein an interior of the second pocket is visible through the second window.

10. The changeable sign as defined in claim 9, further comprising:

one or more second display cards, wherein each second display card is shaped and sized to be received in the second pocket and has different text or images thereon; and wherein the one or more second display cards form a set of second display cards that is received in the second pocket; and when the set of second display cards are so received, the text or images on an outermost one of the one or more second display cards is visible through the second window.

11. The changeable sign as defined in claim 10, wherein each of the one or more second display cards has an upper edge, a lower edge, a first side and a second side; wherein a tab extends outwardly from one of the first side or the second side of the one or more second display cards; and when the set of second display cards is received in the second pocket, the tab on each of the one or more second display cards extends outwardly beyond a side of the housing.

12. The changeable sign as defined in claim 10, wherein each of the one or more second display cards includes an upper edge, a lower edge, a first side and a second side; wherein one of the upper edge or the lower edge of each of the one or more second display cards has a limiting member that engages a portion of the housing when an associated second display card is inserted into the second pocket; and wherein the limiting member limits a degree of insertion of the associated second display card into the second pocket.

13. The changeable sign as defined in claim 9, further comprising:

a third pocket defined in the housing, said third pocket being separated from the pocket and the second pocket; and a third window provided on the front wall of the housing, wherein an interior of the third pocket is visible through the third window.

14. The changeable sign as defined in claim 13; further comprising:

one or more second display cards that are selectively receivable in the second pocket; wherein each of the one or more second display cards has an upper edge, a lower edge, a first side and a second side; and wherein a tab extends outwardly from the first side or the second side of each of the one or more second display cards and outwardly beyond a side of the housing when the one or more second display cards are received in the second pocket; and wherein the one or more second display cards is selectively individually removable from the second pocket or insertable into the second pocket; and a single third display card shaped and sized to be received within the third pocket; wherein the third display card is free of tabs and is semi-permanently retained within the third pocket.

15. The changeable sign as defined in claim 1, further comprising:

at least one additional pocket defined in the housing; wherein the at least one additional pocket is separated from the pocket;

at least one additional window provided on the front wall; wherein an interior of the at least one additional pocket is visible through the at least one additional window; and at least one additional set of display cards shaped and sized to be received in one of the one or more additional pockets;

wherein each display card in the set of display cards or in the at lest one additional set of display cards has different text or images thereon; and when the set of display cards is received in the pocket, the text or images on an outermost display card of the set of display cards is visible through the window; and the different text or images on an outermost display card of the at least one additional set of display cards is visible through the at least one additional window.

16. The changeable sign as defined in claim 15, wherein display cards in the additional set of display cards are semi-permanently engaged in at least one of the one or more additional pockets.

17. A method of changing information displayed on a wall sign; said method comprising the steps of:

providing a changeable sign comprising a housing having a front wall with an upper edge, a lower edge, a first side and a second side; a rear wall, with an upper edge, a lower edge, a first side, and a second side; a first spacer and a second spacer positioned between the front wall and the rear wall, wherein the second spacer is located a distance away from the first spacer; a pocket defined between an interior surface of the front wall and an interior surface of the rear wall of the housing and between the first spacer and the second spacer; a window provided on the front wall, wherein an interior of the pocket is visible through the window; a first set of display cards shaped and sized to be received in the pocket, wherein each of the one or more display cards has an upper edge, a lower edge, a first side, and a second side, and wherein each of the one or more display cards has different text or images thereon; wherein one of the upper edge or the lower edge includes a first limiting member and the other of the upper edge and the lower edge includes a second limiting member; and the first limiting member selectively engages a portion of the housing when an associated display card is inserted into the pocket and the first limiting member limits a degree of insertion of the associated display card into the pocket; wherein the first limiting member engages a region of one of the first spacer and the second spacer; and the second limiting member engages a region on the other of the first spacer and the second spacer and wherein the regions of the one of the first and second spacers engaged by the first limiting member or the second limiting member is a chamfer that angles inwardly toward the interior of the pocket; a shoulder provided on the lower edge of each of the one or more display cards, said shoulder being located a distance inwardly from one of the first side or the second side of the associated display card; and a shoulder provided on the second spacer, wherein the spacer's shoulder is located a distance inwardly from the chamfer; and wherein the display card's shoulder and the spacer's shoulder are complementary and selectively interlock the associated display card and the housing together; and wherein the one or more display cards forms a first set of display cards that is receivable in the pocket; and when the first set of display cards is so received, the text or images on an outermost display card of the set of display cards is visible through the window;

inserting the first set of display cards into the first pocket;

positioning an outermost display card of the first set of display cards adjacent the first window;

selectively interlocking the outermost display card's shoulder with the spacer's shoulder;

interlocking the outermost display card and the spacer's shoulder together;

displaying the text or graphics on the outermost display card through the first window.

18. The method as defined in claim 17, further comprising:

selecting one of the one or more display cards from a remaining portion of the first set of display cards;

removing the selected one of the display cards from the first pocket; and inserting the removed display card in front of the outermost display card;

selectively interlocking the inserted display card's shoulder with the spacer's shoulder;

interlocking the inserted display card and the spacer's shoulder together;

displaying the text or graphics on the inserted display card through the first window.

* * * * *